US006173132B1

(12) United States Patent
Kida et al.

(10) Patent No.: US 6,173,132 B1
(45) Date of Patent: Jan. 9, 2001

(54) VENTILATION SYSTEM FOR AN IMAGE FORMING APPARATUS

(75) Inventors: Hiroshi Kida; Masao Matsui; Takashi Yamanaka, all of Yamatokoriyama (JP)

(73) Assignee: Sharp Kabushiki Kaisha, Osaka (JP)

( * ) Notice: Under 35 U.S.C. 154(b), the term of this patent shall be extended for 0 days.

(21) Appl. No.: 09/359,125

(22) Filed: Jul. 23, 1999

(30) Foreign Application Priority Data

Jul. 27, 1998 (JP) ..... 10-211526

(51) Int. Cl.[7] ..... G03G 21/20

(52) U.S. Cl. ..... 399/44; 399/45; 399/69; 399/92

(58) Field of Search ..... 399/44, 45, 69, 399/92, 94; 219/216; 432/60

(56) References Cited

U.S. PATENT DOCUMENTS

| | | | | |
|---|---|---|---|---|
| 3,901,591 | * | 8/1975 | Mitsumasu | 399/92 |
| 5,038,170 | * | 8/1991 | Serita | 399/92 |
| 5,166,727 | * | 11/1992 | Miyamoto et al. | 399/92 |
| 5,307,132 | * | 4/1994 | Tsuchiya | 399/92 X |
| 5,325,158 | * | 6/1994 | Guelfo et al. | 399/92 |
| 5,479,242 | * | 12/1995 | Sato et al. | 399/92 |
| 5,878,304 | * | 3/1999 | Watanabe et al. | 399/92 |
| 6,008,829 | * | 12/1999 | Wakamiya et al. | 399/69 X |

FOREIGN PATENT DOCUMENTS

| | | |
|---|---|---|
| 61-133968 | 6/1986 | (JP) . |
| 4-369678 | 12/1992 | (JP) . |
| 7-28356 | 1/1995 | (JP) . |
| 7-160178 | 6/1995 | (JP) . |

* cited by examiner

*Primary Examiner*—William J. Royer
(74) *Attorney, Agent, or Firm*—Nixon & Vanderhye P.C.

(57) ABSTRACT

It is an object of the present invention to provide an energy-saving image forming apparatus capable of fixing toner in a reliable manner to enhance the quality of images, control the temperature of toner residue to reuse the toner in a reliable manner, and reduce the power consumption of the apparatus. In a copier, a photoconductive drum carries a toner image to be transferred to a recording medium, a heater of a fixing unit fixes the transferred toner image on the recording medium, and a cleaning unit removes toner residue on the photoconductive drum after transfer. The whole copier is covered with a housing, a first ventilation system ventilates the inside and outside of the housing, and a controlling section regulates the amount of ventilation by the first ventilation system in accordance with an output from a temperature sensor for detecting the temperature of the cleaning unit. As a result, it is possible to effectively reuse the collected toner and ensure excellent quality images.

11 Claims, 3 Drawing Sheets

VENTILATION SYSTEM FOR AN IMAGE FORMING APPARATUS

BACKGROUND OF THE INVENTION

1. Field of the Invention

The present invention relates to an image forming apparatus such as a copier, comprising a heat source for fixing toner on a recording medium and a fan for ventilating the inside of a housing.

2. Description of the Related Art

In recent years, it has been desired that an image forming apparatus such as a copier is designed in consideration of saving energy, for example, the Energy Star. The Energy Star is a standard for low power consumption regulated by the Environmental Protection Agency (EPA) of the U.S.A. in the International Energy Star Program. For saving energy, it is particularly effective to cut down power consumption in a fixing unit of the image forming apparatus, and specifically the following measures are possible.

First of all, it is effective to use a material having a relatively low melting point as toner. In the case where toner having a low melting point is used, a low temperature may be set as a fixing temperature with the result that power consumption of the fixing unit is reduced. In general, the fixing unit has a fixing roller composed of a fixed shaft member incorporating a heater, and a rotating sleeve which covers the shaft member. By using a very thin sleeve a period of time for warming up can be reduced, and, as a result, reduction of the power consumption of the fixing unit can be achieved.

In an image forming apparatus of Japanese Unexamined Patent Publication JP-A 7-160178 (1995), a temperature sensor is provided in a fixing unit and a cooling fan is provided in the image forming apparatus itself, which cooling fan is controlled so as not to be actuated before the temperature of the temperature sensor rises up to a sufficiently high temperature, whereby the power consumption of the cooling fan is cut down.

In an image forming apparatus of Japanese Unexamined Patent Publication JP-A 7-28356 (1995), a temperature sensor is provided in a fixing roller of a fixing unit and an exhaust fan is provided in the image forming apparatus itself to exhaust hot air coming from the fixing unit, and in a waiting state, the temperature for the fixing unit is set to a lower temperature than usual and the exhaust fan is controlled so as to rotate at a lower speed than usual, for the purpose of reducing the power consumption of the exhaust fan.

Japanese Unexamined Patent Publication JP-A 61-133968 (1986) discloses an image forming apparatus comprising a fixing unit having a fixing roller incorporating a heater, a cleaning unit for cleaning toner residue on a photoconductor, a fixing thermistor for detecting the temperature of the fixing roller, and a cleaning thermistor for detecting the temperature of the cleaning unit. In this fixing unit, an output of the heater is controlled in accordance with a temperature detected by the fixing thermistor and a temperature detected by the cleaning thermistor, whereby the power consumption of the heater can be reduced.

However, in the case where toner having a low melting point is used, toner collected by the cleaning unit melts under the influence of heat from the fixing unit. Once the toner has melted, it solidifies in the state of agglomeration. Accordingly it is hard to convey it to reuse. Even when the toner is conveyed to reuse, it has an adverse effect of, for example, causing inconsistency in density of an image formed on a recording medium.

Moreover, in the case where a sleeve of the fixing roller is very thin, a recording medium deprives heat from the sleeve, with the result that the temperature of the fixing unit is lowered. When the fixing temperature is lowered, toner is not fixed sufficiently, with the result that the quality of images formed on the recording medium is degraded.

Further, in JP-A 7-160178 and JP-A 7-28356, the operations of the fans are controlled in accordance with the temperature of the fixing unit alone, so that it is impossible to control the temperatures of all components except the fixing unit. As a result, the quality of images formed on a recording medium may be degraded by some changes in characteristics of electronic components in the image forming apparatus, or some changes in physical status of the toner.

Furthermore, JP-A 61-133968 discloses that only the output of the heater is controlled. Accordingly it is difficult to control temperatures of components except a fixing unit. In the case where importance is attached to the temperature of the fixing unit, overheat occurs in the components except the fixing unit, especially, in the cleaning unit, and hence, the same as in the case of using toner having a low melting point, it is also difficult to reuse toner. Even when the toner can be reused, it degrades the quality of images. On the other hand, in the case where importance is attached to the temperature of the cleaning unit, the toner is not fixed sufficiently because of reduction of the fixing temperature, with the result that the quality of images is degraded.

SUMMARY OF THE INVENTION

It is an object of the invention to provide an energy-saving image forming apparatus capable of fixing toner in a reliable manner to enhance the quality of images, control the temperature of toner residue to reuse the toner in a reliable manner, and reduce power consumption of the apparatus.

The invention provides an image forming apparatus comprising:

- a housing;
- a carrier for carrying a toner image to be transferred to a recording medium;
- fixing means having a heat source, for fixing the transferred toner image on the recording medium;
- cleaning means for removing toner residue on the carrier after transfer;
- ventilating means for ventilating the inside and outside of the housing;
- a cleaning temperature sensor for detecting a temperature of the cleaning means; and
- controlling means for control of ventilation amount by the ventilating means in accordance with an output from the cleaning temperature sensor.

According to the invention, a toner image carried on the carrier is transferred to a recording medium, and the transferred toner image is fixed on the recording medium by the fixing means. Toner residue on the carrier after transfer of the toner image is removed by the cleaning means. Heat from the heat source of the fixing means diffuses in the housing and also transmits to the cleaning means. The controlling means controls the amount of ventilation by the ventilating means in accordance with the temperature of the cleaning means.

As shown above, the temperature of the cleaning means is detected and the amount of ventilation by the ventilating means is controlled, so that it is possible to exhaust hot air from the housing by controlling the ventilating means so that the temperature of the cleaning means does not rise up to around the melting point of toner. Therefore, it is possible to prevent the toner collected by the cleaning means from melting, and hence it is possible to effectively reuse the collected toner and ensure excellent quality images.

Further, the invention provides an image forming apparatus comprising:

a housing;

a carrier for carrying a toner image to be transferred to a recording medium;

fixing means having a heat source, for fixing the transferred toner image on the recording medium;

cleaning means for removing toner residue on the carrier after transfer;

ventilating means for ventilating the inside and outside of the housing;

a fixing temperature sensor for detecting temperature of the fixing means;

a cleaning temperature sensor for detecting temperature of the cleaning means; and controlling means for control of the amount of heat radiation from the heat source and amount of ventilation by the ventilating means in accordance with outputs from the fixing temperature sensor and the cleaning temperature sensor.

According to the invention, the temperatures of the fixing means and the cleaning means are detected, and the amount of heat radiation from the heat source and the amount of ventilation from the ventilating means are controlled, so that temperature control for avoiding an increase in the temperature of the cleaning means up to around the melting point of the toner without lowering the temperature of the fixing means can be achieved. Therefore, it is prevented that the quality of images is degraded by insufficient fixation of toner, and it is prevented that toner to be reused is degraded, whereby excellent quality images can be realized. Moreover, by the temperature control in the aforementioned manner, it is possible to avoid overheating and overcooling, with the result that the power consumption for heating and cooling is reduced.

In the invention it is preferable that the controlling means has a plurality of control modes for keeping the fixing means in different temperature conditions, and the image forming apparatus further comprises inputting means for inputting a direction to power the apparatus on or start forming an image, and shifting means for carrying out a shift among the plurality of control modes of the controlling means on the basis of a signal from the inputting means.

According to the invention, when the operator directs to power the apparatus on through the inputting means, the shifting means carries out a shift among the plurality of control modes of the controlling means on the basis of a signal from the inputting means. For example, it is possible that the controlling means is shifted to a control mode of warming up the fixing means soon after the apparatus is powered on, and to another control mode when the temperature reaches a preset temperature, thereby maintaining a certain temperature so that image formation can be started at any time. Moreover, when the operator directs to start image formation through the inputting means, the shifting means also carries out a shift among the plurality of control modes of the controlling means on the basis of a signal from the inputting means. For example, the shifting means shifts the controlling means to still another control mode soon after the direction to start image formation is given, thereby keeping the temperature of the fixing means at a certain temperature which is necessary while forming an image.

As described above, in accordance with a control mode regarding an operation of the image forming apparatus such as to power the apparatus on or start forming an image, the amount of ventilation is controlled, or the amounts of heat radiation and ventilation are controlled in combination, so that it is possible to reduce useless power consumption furthermore.

In the invention it is preferable that the controlling means has a plurality of control modes for keeping the fixing means in different temperature conditions, and the image forming apparatus further comprises inputting means for inputting a designation of material of the recording medium, and shifting means for carrying out a shift among the plurality of control modes of the controlling means on the basis of a signal from the inputting means.

According to the invention, the operator designates the material of the recording medium through the inputting means. For example, the operator designates the material of the recording medium by selecting a feeding tray which contains a recording medium of desired material from among a plurality of feeding trays. When the material of the recording medium is designated, the shifting means shifts the controlling means on the basis of a signal from the inputting means. For example, when paper for PPC (Plain Paper Copier) is selected, the shifting means shifts the controlling means to a control mode of maintaining the temperature of the fixing means relatively low, and when paper for OHP (Overhead Projector) is selected, the shifting means shifts the controlling means to a control mode of maintaining the temperature of the fixing means relatively high.

As described above, in accordance with the material of the recording medium, the amount of ventilation can be controlled, or the amount of ventilation and of heat radiation can be controlled, so that it is possible to fix toner in a reliable manner, and it is possible to avoid unnecessarily driving the heat source to reduce the power consumption.

Furthermore, the invention provides an image forming apparatus comprising:

a housing;

a carrier for carrying a toner image to be transferred to a recording medium;

fixing means having a heat source for fixing the transferred toner image on the recording medium;

cleaning means for removing toner residue on the carrier after transfer;

ventilating means composed of an entirety ventilating section for ventilating the entirety of the inside of the housing and a part ventilating section for ventilating a partial region of the inside of the housing, the partial region including the fixing means and the cleaning means;

a fixing temperature sensor for detecting temperature of the fixing means;

a cleaning temperature sensor for detecting temperature of the cleaning means; and controlling means for individual control of ventilation amount of each of the entirety ventilating section and the part ventilating section in accordance with outputs from the fixing temperature sensor and the cleaning temperature sensor.

According to the invention, the ventilating means includes the entirety ventilating section and the part ventilating section, so that by mounting the part ventilating section on a spot in the housing where heat is particularly likely generated, cooling concentrated only onto the spot of the heat source can be achieved. The entirety ventilating section may be used only in a special case e. g. in the case where the entirety of the inside of the housing gets hot. By thus using the entirety ventilating section and the part ventilating section properly, the power consumption can be reduced.

Still further, the invention provides an image forming apparatus comprising:

a housing;

a carrier for carrying a toner image to be transferred to a recording medium;

fixing means having a heat source for fixing the transferred toner image on the recording medium;

cleaning means for removing toner residue on the carrier after transfer;

ventilating means composed of a first part ventilating section for ventilating a first region in the housing which includes the fixing means and the cleaning means, and a second part ventilating section for ventilating a second region in the housing which excludes the first region;

a fixing temperature sensor for detecting temperature of the fixing means;

a cleaning temperature sensor for detecting temperature of the cleaning means; and controlling means for individual control of ventilation amount of each of the first and second ventilating sections in accordance with outputs from the fixing temperature sensor and the cleaning temperature sensor.

According to the invention, the temperature of the cleaning means is detected and the amount of ventilation by the ventilating means is controlled, so that it is possible to exhaust the hot air from the housing by controlling the ventilating means so as to avoid an increase in the temperature of the cleaning means up to around the melting point of toner. Therefore, the toner collected by the cleaning means can be prevented from melting, whereby the collected toner is effectively reused for forming excellent quality images.

Moreover, the ventilating means includes the first part ventilating section and the second part ventilating section. The first part ventilating section ventilates only the first region inside the housing, and the second part ventilating section ventilates only the second region inside the housing. The first region contains the fixing means and the cleaning means, which particularly require temperature control. Therefore, when a temperature outputted from the fixing temperature sensor or the cleaning temperature sensor is relatively low, it is possible to sufficiently cool by driving only the first part ventilating section. On the other hand, when a temperature outputted from the fixing temperature sensor or the cleaning temperature sensor is relatively high, it is possible to increase a cooling capability by driving not only the first part ventilating section but also the second ventilating section. As shown above, the ventilating means can be effectively driven as necessary, whereby the power consumption of the apparatus can be reduced.

Still further, the invention provides an image forming apparatus comprising:

a housing;

a carrier for carrying a toner image to be transferred to a recording medium;

fixing means having a heat source composed of a plurality of heaters for fixing the transferred toner image on the recording medium;

cleaning means for removing toner residue on the carrier after transfer;

ventilating means for ventilating the inside and outside of the housing;

a fixing temperature sensor for detecting temperature of the fixing means;

a cleaning temperature sensor for detecting temperature of the cleaning means; and controlling means for individual control of amount of heat radiation of each of the heaters in accordance with outputs from the fixing temperature sensor and the cleaning temperature sensor.

According to the invention, the amounts of heat radiation from the respective heaters are individually controlled in accordance with the outputs from the fixing temperature sensor and the cleaning temperature sensor. Therefore, it is possible to control driving of the heaters in accordance with the temperature condition, that is, when the temperature is relatively high, only some of the heaters are driven, and when the temperature is relatively low, all of the heaters are driven. Thus, it is possible to reduce the power consumption by properly using the plurality of heaters, and it is possible to prevent the toner from melting by controlling the temperature of the cleaning means to avoid formation of low quality images.

In the invention it is preferable that the fixing means further includes a roller incorporating the heaters and a pressuring member which pressures the roller, that the heaters include at least a first heater for heating a center portion of the roller and a second heater for heating an end portion of the roller, and that the controlling means applies a preset amount of power to at least one of the first heater and the second heater when the recording medium to which toner is transferred passes the fixing means.

According to the invention, a roller incorporating the heaters and a pressuring member constitute the fixing member, so that the recording medium can be conveyed while being sandwiched between them, and at the same time, the recording medium can be heated and pressured. Thus, it is allowed to fix toner on the recording medium in a simple and reliable manner.

Moreover, in the case where recording mediums of various sizes pass the fixing means, specifically, in the case where all the sizes of recording mediums pass the center of the fixing means, the heat can be compensated for by driving only the first heater when a relatively small recording medium passes, and the heat can be compensated for the heat by driving both the first heater and the second heater when a large recording medium passes. In this way, it is possible to properly use the first heater and the second heater in accordance with the size of the recording medium used in forming images, whereby toner can be fixed in a reliable manner and the power consumption can be reduced.

In addition, since only a preset amount of electricity which equals the necessary amount of heat radiation is passed through the heater in synchronization with the passage timing of a recording medium which requires heat supply the most, it is possible to avoid useless power consumption, and it is possible to surely compensate for heat deprived by the recording medium and preferably fix toner on the recording medium to be conveyed later.

In the invention it is preferable that the fixing means further includes a roller incorporating the heaters and a pressuring member for pressuring the roller, that the heaters include at least a first heater for heating a center portion of the roller and a second heater for heating an end portion of the roller and that the controlling means applies preset amounts of power to the first heater and the second heater, respectively, right before a recording medium to which toner is transferred passes the fixing means.

According to the invention, heat is supplied in advance right before a moment of passage of a recording medium, in which moment heat is deprived by the recording medium, so that the temperature which is necessary for the fixation can be ensured all the time, and toner can be fixed in a more reliable manner.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
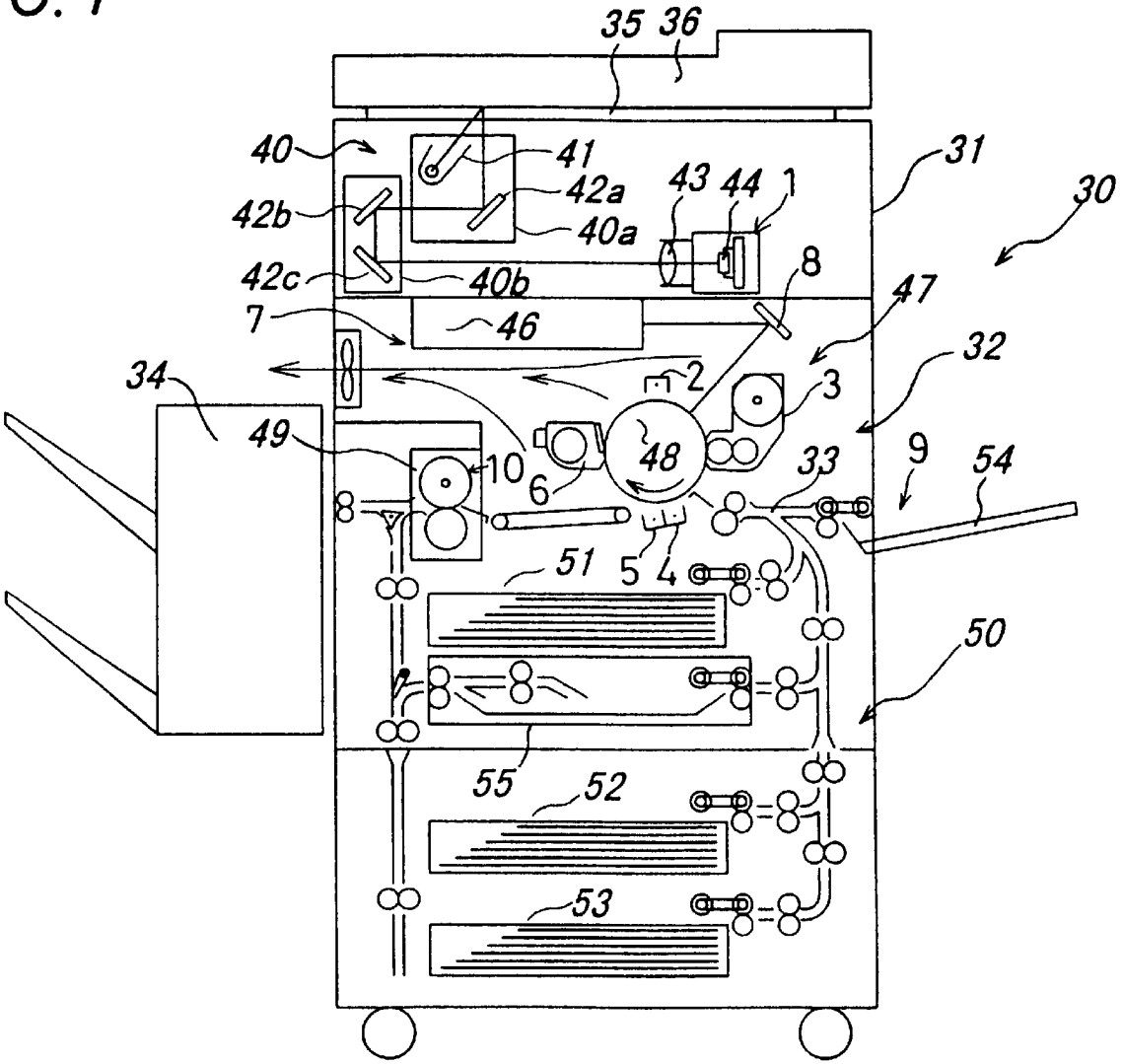
FIG. 1 is a view showing a configuration of a copier 30, which is a first embodiment of the invention.

Now referring to the drawings, preferred embodiments of the invention are described below.

FIG. 1 is a view showing a configuration of a copier 30, which is a first embodiment of the invention. The copier 30 has a housing 31, and an automatic document feeder 36 is mounted above this housing 31. The copier 30 comprises a document reading section 40 for reading image information of a document to be copied, and an image forming section 47 for forming a copied image based on the read image information. The document reading section 40 is placed in the upper portion of the housing 31, and the image forming section 47 is placed in the lower portion of the housing 31.

At first, the document reading section 40 will be briefly explained. The document reading section 40 includes a first optical unit 40*a*, a second optical unit 40*b*, and a light-receptive unit 1. On the top face of the housing 31, a document plate 35 made of transparent glass is mounted, and the automatic document feeder 36 is mounted so as to cover this document plate 35. The automatic document feeder 36 sends documents to be copied one by one to the document plate 35 and positions them thereon, which documents positioned on the document plate 35 are read by the action of the document reading section 40.

The first optical unit 40*a* includes an exposure lamp 41 for exposing a document on the document plate 35 and a first reflection mirror 42*a*, and the second optical unit 40*b* includes a second reflection mirror 42*b* and a third reflection mirror 42*c*. Further, the light-receptive unit 1 includes a lens assembly 43 having a plurality of lenses and a photoreceptor device 44 such as a CCD (charge-coupled device). On scanning a document, the first optical unit 40*a* is moved substantially parallel along the document plate 35 toward the right side in FIG. 1 at a preset speed, and the second optical unit 40*b* is moved substantially parallel toward the right side in FIG. 1 at a half speed of the preset speed. The exposure lamp 41 irradiates a document on the document plate 35. A reflection light from the document is guided to the lens assembly 43 after sequentially reflected by the first reflection mirror 42*a*, the second reflection mirror 42*b* and the third reflection mirror 42*c*, and received by the photoreceptor device 44 through the lens assembly 43.

Consequently, the image information of the document is read by the photoreceptor device 44. The read image information is sent as image data to image data processing means which is not shown, processed as required by the image data processing means, and thereafter stored once in an image memory which is not shown. The image information stored in the image memory is then supplied to the image forming section 47, where a copied image of the document is formed.

The image forming section 47 includes a copied image forming section 32 for forming a copied image and a recording medium supplying section 50 for supplying a sheet of recording medium to the copied image forming section 32. The copied image forming section 32 includes a photoconductive drum 48 with a photoconductive layer on its surface. Around the photoconductive drum 48 to be revolved in a direction shown by an arrow, a charger 2 for applying electric charge, a developing unit 3, a charger 4 for transfer, a charger 5 for peeling, and a cleaning unit 6 are placed in this order. The photoconductive drum 48, the electric charge applying charger 2, the developing unit, etc. constitute a xerographic process section for carrying out a xerographic process.

Above the photoconductive drum 48, a scanning unit 7 is provided, which irradiates the surface of the photoconductive drum 48 after applying electric charge with laser light carrying the image information. The scanning unit 7 includes a laser optical unit 46, and in the laser optical unit 46, a laser light source or the like is provided, which irradiates with laser light carrying the image information. The configuration of this laser optical unit 46 will be described later. The scanning unit 7 further includes a reflection mirror 8, and laser light from the laser optical unit 46 is reflected by the reflection mirror 8 and thereafter guided to the surface of the photoconductive drum 48.

In the housing 31, a conveying path 33 extends, which is used for conveying a recording medium through between the photoconductive drum 48 and both the transfer charger 4 and the peeling charger 5. This conveying path 33 extends to the right side in FIG. 1, to one end of which a paper-feeding table mechanism 9 is provided. The paper-feeding table mechanism 9 sends recording mediums placed on a paper-feeding table 54 one by one to the conveying path.

Moreover, the other end of the conveying path 33 is branched, extending up to a double-sided copy paper feeding unit 55 which is placed below the conveying path 33 and recording medium supplying units 51, 52, 53 which hold recording mediums. The double-sided copy paper feeding unit 55, which is used for forming a copied image on both sides of a recording medium, temporarily stores a recording medium with a copied image on one side thereof, and again sends this recording medium to the conveying path 33 in order to form a copied image on the other side thereof. Further, the recording medium supplying units 51, 52, 53 send the recording mediums stored in the stacked status one by one towards the conveying path 33.

On the downstream side of the conveying path 33, a fixing unit 49 is mounted. The fixing unit 49 includes a pair of fixing rollers 10, by which rollers a toner image formed on the surface of the recording medium is fixed and made to be a permanent image. On the other side of the conveying path 33, an after process unit 34 is provided as a sorter for sorting the recording mediums after copy.

Figure 2:
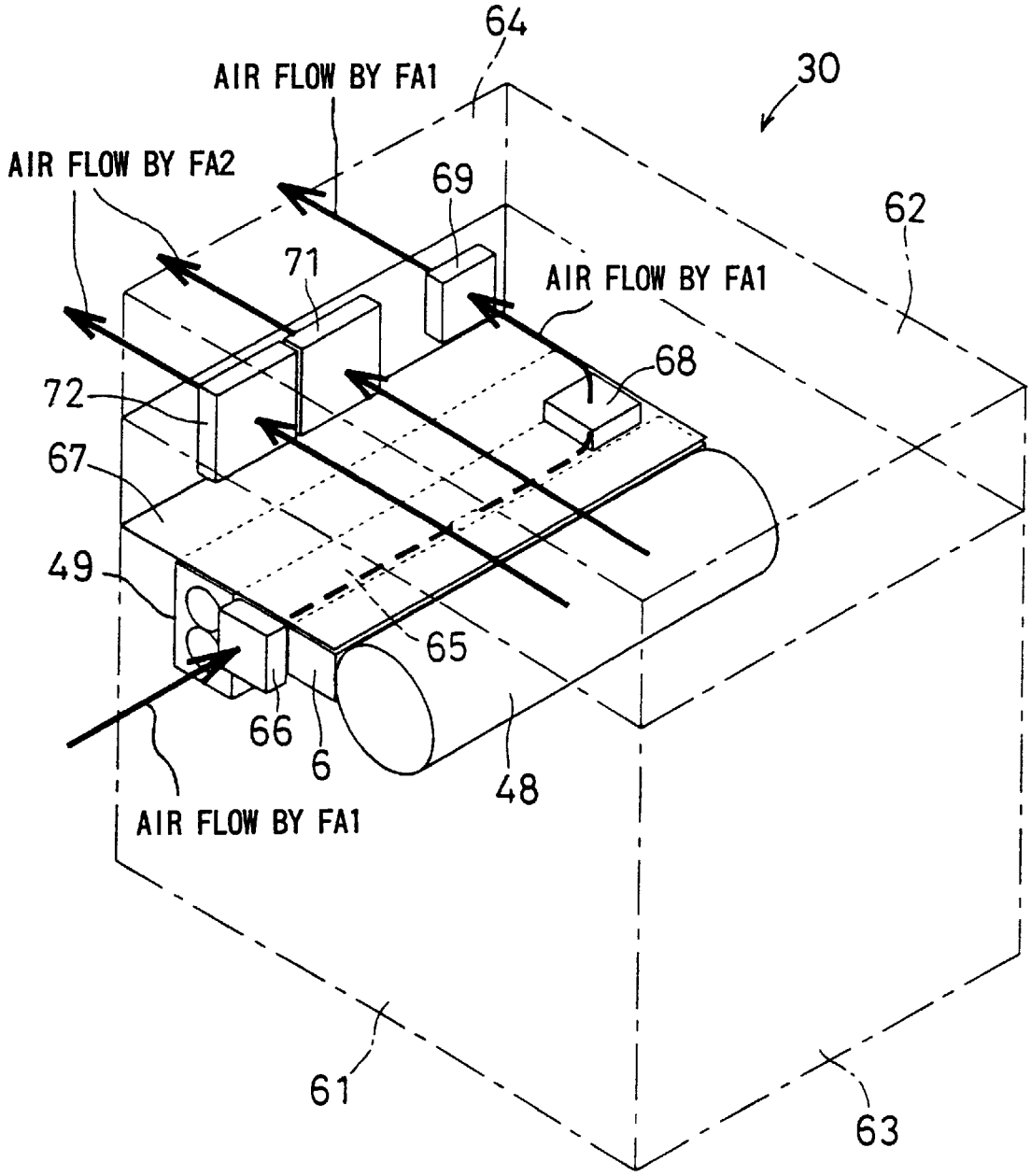
FIG. 2 is a perspective view showing a ventilation system of FIG. 1.

FIG. 2 is a view showing a ventilation system of FIG. 1. The housing 31 has a front board 61, a rear board 62 and side boards 63, 64. The photoconductive drum 48 is placed so that its rotation axis is present from the front board 61 toward the rear board 62. A recording medium is conveyed from the side of the side board 63 to the photoconductive drum 48, and further conveyed toward the side board 64 when transferring an image is finished. On the side of the side board 64, which side corresponds to the downstream side from the photoconductive drum 48 in a direction where the recording medium is conveyed, the cleaning unit 6 is placed so as to be opposed to the photoconductive drum 48. The cleaning unit 6 is covered with a box-shape housing which extends along the rotation axis of the photoconductive drum 48. On the further downstream side from the cleaning unit 6 in the direction of conveying the recording medium, the fixing unit 49 is placed so as to be spaced from the cleaning unit 6. The fixing unit 49 is covered with a box-shape housing which extends parallel with the rotation axis of the photoconductive drum 48, containing the pair of fixing rollers 10 in the housing.

On a portion of the front board 61 which is located at one end of a space 65 interposed between the cleaning unit 6 and the fixing unit 49, a fan 66 is mounted. The fan 66 takes in air from the outside of the housing 31 and feeds it into the housing 31. The air fed into the housing 31 by the fan 66 flows in the space 65 toward the rear board 62. Above the fixing unit 49 and the cleaning unit 6, a partition wall 67 is provided so as to define the upper face of the space 65. On a portion of the partition wall 67 which is located above the end of the space 65 on the side of the rear board 62, a fan 68 is provided. The fan 68 feeds the air from the space 65 above the partition wall 67. At a position corresponding to a part of the side border side wall 64 which is the closest to the fan 68, a fan 69 is mounted to exhaust the air coming from the fan 68 to the outside of the housing 31.

On the side wall 64, beside the fan 69, fans 71 and 72 are mounted so as to be adjacent to each other. The fans 71 and 72 are positioned above the partition wall 67 to flow the air in the housing 31 from a side face to another side face to exhaust it to the outside of the housing 31.

The fans 66, 68 and 69 constitute a first ventilation system FA1, and the fans 71 and 72 constitute a second ventilation system FA2. It is a main object of the first ventilation system FA1 to exhaust the air of the space 65 to cool the fixing unit 49 and the cleaning unit 6. The second ventilation system FA2 is used for exhausting ozone generated from a charger, a radiator and the like or toner scattered from a development bath and for removing the heat of a motor of a driving system. Further, the fans 66, 68, 69, 71 and 72 are all axial-flow blowers, implementing a low-profile structure.

Figure 3:
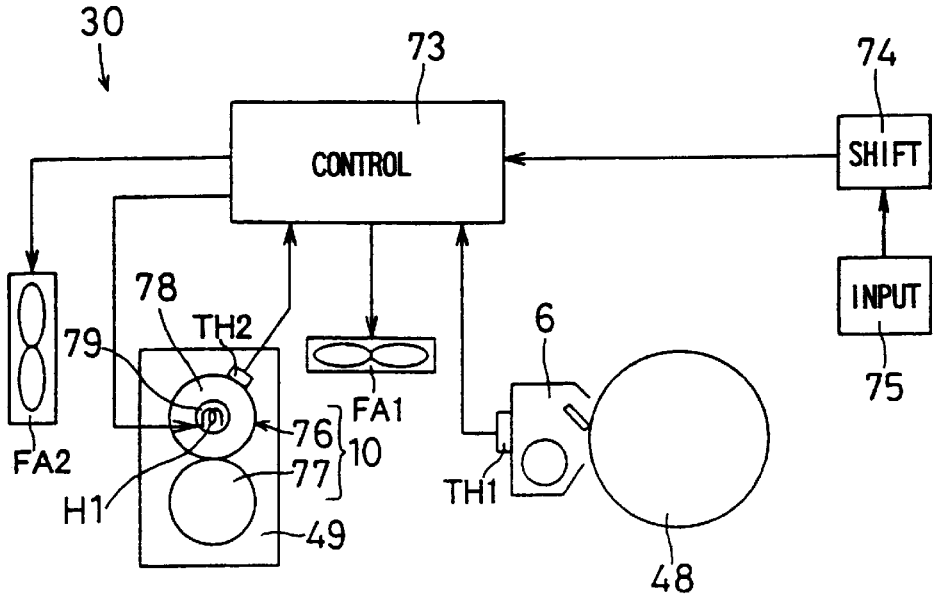
FIG. 3 is a view mainly showing an electrical configuration of the copier 30.

FIG. 3 is a view mainly showing an electrical configuration of the copier 30. To the cleaning unit 6, a temperature sensor TH1 is mounted. The pair of fixing rollers 10 of the fixing unit 49 are composed of a heat roller 76 and a pressure roller 77. The heat roller 76 includes a fixed shaft member 79 which incorporates a heater H1, and a sleeve 78 which rotates around the shaft member 79. To the sleeve 78, a temperature sensor TH2 is mounted. The copier 30 further comprises a controlling section 73. The controlling section 73 controls driving of the first ventilation system FA1, the second ventilation system FA2 and the heater H1 on the basis of temperature information from the temperature sensors TH1 and TH2.

As for the heater H1, a period of time of applying power is controlled at a preset voltage, whereby the amount of heat radiation from the heater H1 is controlled. As for the first ventilation system FA1 and the second ventilation system FA2, voltages applied to each of the fans constituting the respective systems are regulated, whereby the rotation speed of the fans is controlled. As a result, the volume of the air from the fans, that is, the amount of ventilation is controlled. A shifting section 74 and an inputting section 75 will be mentioned later in a second embodiment.

In this embodiment, such a sleeve 78 having a small thickness of about 1.1 mm is used and toner having a relatively low softening point, e.g., about 120° C., is used so as to comply with the Energy Star. Even when such a thin sleeve 78 and toner having a low melting point are used, the heater H1, the first ventilation system FA1 and the second ventilation system FA2 are controlled in accordance with the detected temperatures of the temperature sensors TH1, TH2 as described above, whereby precise temperature control can be achieved, namely, the sleeve 78 can be prevented from being overcooled, and the toner reused can be prevented from melting at the cleaning unit 6.

Further, since the first ventilation system FA1 and the second ventilation system FA2 are separated by the partition wall 67, and hence an air flow by the first ventilation system FA1 and an air flow by the second ventilation system FA2 are not mixed with each other, it is possible to individually control the temperatures without considering an influence by one system on the other system, and temperature control is facilitated.

Although the first ventilation system FA1 and the second ventilation system FA2 are thus separated by the partition wall 67, such a configuration in which the partition wall 67 is eliminated is also available in the first embodiment. In the configuration of no partition wall, the first ventilation system FA1 can ventilate a partial area in the housing 31 including the fixing unit 49 and the cleaning unit 6, and the second ventilation system FA2 can ventilate the whole area in the housing 31. Therefore, it is possible to reduce the power consumption of the apparatus by appropriately using the first ventilation system FA1 and the second ventilation system FA2. Further, it is possible to ventilate rapidly and reliably by using both the first ventilation system FA1 and the second ventilation system FA2.

A second embodiment of the invention will be described in the following. The second embodiment shows the copier 30 of the first embodiment equipped with the shifting section 74 and the inputting section 75 which are shown in FIG. 3. The controlling section 73 has five control modes regarding the operation of the copier 30 as described in the following, and the shifting section 74 shifts the controlling section 73 from one mode to another mode. The inputting section 75 is a switch or the like through which the operator directs to power the apparatus on or start copying.

The first control mode of the controlling section 73 is a warm-up mode. When the apparatus is powered on through the inputting section 75, the shifting section 74 shifts the controlling section to the warm-up mode. In the warm-up mode, the controlling section 73 applies power to the heater H1 to warm up the fixing unit 49 until the fixing unit 49 reaches a preset temperature T1. The temperature T1 is a temperature slightly lower than a temperature T2 at which toner can be fixed. The temperature T1 is, for example, 190° C. When the temperature reaches the temperature T1, the shifting section 74 shifts the controlling section 73 to a ready mode which is a second control mode. In the ready mode, the controlling section 73 maintains the fixing unit 49 at the temperature T1 and waits so as to be able to start copying at any time.

When it is directed to start copying during standby in the ready mode, the shifting section 74 shifts the controlling section 73 to a copy mode which is a third control mode. In the copy mode, the controlling section 73 controls the fixing unit so that the temperature thereof is maintained at the temperature T2 while copying is executed. Further, when it is not directed to start copying for a preset period of time in the ready mode, the shifting section 74 shifts the controlling section 73 to a pre-heating mode which is a fourth control mode. In the pre-heating mode, the controlling section 73 controls the fixing unit 49 so that the temperature thereof is maintained at a pre-heating temperature T3 which is lower than the temperature T1. The pre-heating temperature T3 is, for example, 140° C.

When it is directed to start copying in the pre-heating mode, the shifting section 74 shifts the controlling means to are turn mode which is a fifth control mode. In there turn mode, the controlling section 73 raises the temperature of the fixing unit 49 from the pre-heating temperature T3 up to the temperature T1, controls the fixing unit so that the mode thereof is returned to the ready mode, and then shifted to the copy mode.

As described below, the copy mode may be composed of a plurality of control modes which are different depending on the material of the recording medium. That is to say, the inputting section 75 includes a recording medium detecting sensor which is provided in a recording medium paper-feeding table 54. When the recording medium detecting sensor does not detect a recording medium, a sheet of paper for PPC is conveyed from one of the cassettes of the recording medium supplying units 51, 52, 53, and the shifting section 74 shifts the controlling section 73 to a first copy mode. In the first copy mode, the controlling section 73 controls the fixing unit 49 so that the temperature thereof is maintained at a temperature T21. The temperature T21 is a relatively low temperature, e.g., about 190° C., which is enough to fix toner sufficiently in the case where a recording medium is a sheet of paper.

To the contrary, when a recording medium is detected by the recording medium detecting sensor of the inputting section 75, the shifting section 74 shifts the controlling section 73 to a second copy mode. In the second copy mode, the controlling section 73 controls the fixing unit 49 so that the temperature thereof is maintained at a temperature T22. The temperature T22 is a temperature higher than the temperature T21, for example, about 200° C., which is enough to fix toner in a reliable manner even in the case of using such a recording medium as an OHP sheet, to which toner is harder to fix than a sheet of paper.

TABLE 1

| Operation mode | Feeding mode | Process temp. | FA1 system | FA2 system | Target temp. |
|---|---|---|---|---|---|
| Warm-up | Cassette/ Hand-feed | <21 | Off | Off | 190 + 10 |
| | | <26 | Off | Off | 190 + 10 |
| | | <45 | Off | Off | 190 + 10 |
| | | 45≦ | 25 | 26 | 190 |
| Copy | Cassette | <21 | 12 | 12 | 190 + 10 |
| | | <26 | 20 | 30 | 190 + 10 |
| | | <45 | 50 | 50 | 190 |
| | | 45≦ | 100 | 100 | 190 − 10 |
| Copy | Hand-feed | <21 | 12 | 12 | 200 |
| | | <26 | 20 | 30 | 200 |
| | | <45 | 50 | 50 | 200 |
| | | 45≦ | 100 | 100 | 200 − 10 |
| Ready | Cassette/ Hand-feed | <21 | 12 | 12 | 190 + 10 |
| | | <26 | 12 | 12 | 190 |
| | | <45 | 20 | 20 | 190 |
| | | 45≦ | 50 | 100 | 190 − 10 |
| | | 48≦ | 50 | 100 | 140 |
| Pre-heating | Cassette/ Hand-feed | <21 | 10 | 10 | 140 |
| | | <26 | 10 | 10 | 140 |
| | | <45 | 10 | 10 | 140 |
| | | 45≦ | 50 | 50 | 140 |
| | | 48≦ | 50 | 100 | 140 |
| Returning from pre-heat | Cassette/ Hand-feed | <21 | Off | Off | 190 + 10 |
| | | <26 | Off | Off | 190 + 10 |
| | | <45 | Off | Off | 190 + 10 |
| | | 45≦ | 25 | 25 | 190 |

Table 1 shows control to the first ventilation system FA1 and the second ventilation system FA2 by the controlling section 73. In Table 1, a segment of a process temperature which is a temperature of the cleaning unit 6 is set for each control mode and feeding mode. The unit of the process temperature is ° C. For example, "<21" defines a temperature segment less than 21° C., and "<26" defines a temperature segment from 21° C. to 26° C. Furthermore, the ratio of a rotation speed of each of the fans constituting the first ventilation system FA1 and the second ventilation system FA2 is set for each segment of the process temperature. The ratio of a rotation speed is expressed as a percentage in which the maximum speed is 100%.

Further, a target temperature of the fixing unit 49 is also shown in Table 1. The unit of the target temperature is ° C. For example, "190+10" indicates an arbitrary temperature in a temperature range of 190° C. to 200° C., and "190−10" indicates an arbitrary temperature in a temperature range of 190° C. to 180° C. When the fixing temperature is decreased by a preset range of temperature to the target temperature, the controlling section 73 controls driving of the heater H1. On the contrary, when the fixing temperature is increased by a preset range of temperature to the target temperature, the controlling section 73 controls the heater H1 to stop the driving thereof. As a result, it is possible to maintain the fixing temperature at the target temperature.

In this way, by executing control in accordance with the control mode in addition to the temperature detected by the temperature sensor, it is possible to control further precisely in accordance with the operation of the copier and the material of recording medium.

Figure 4:
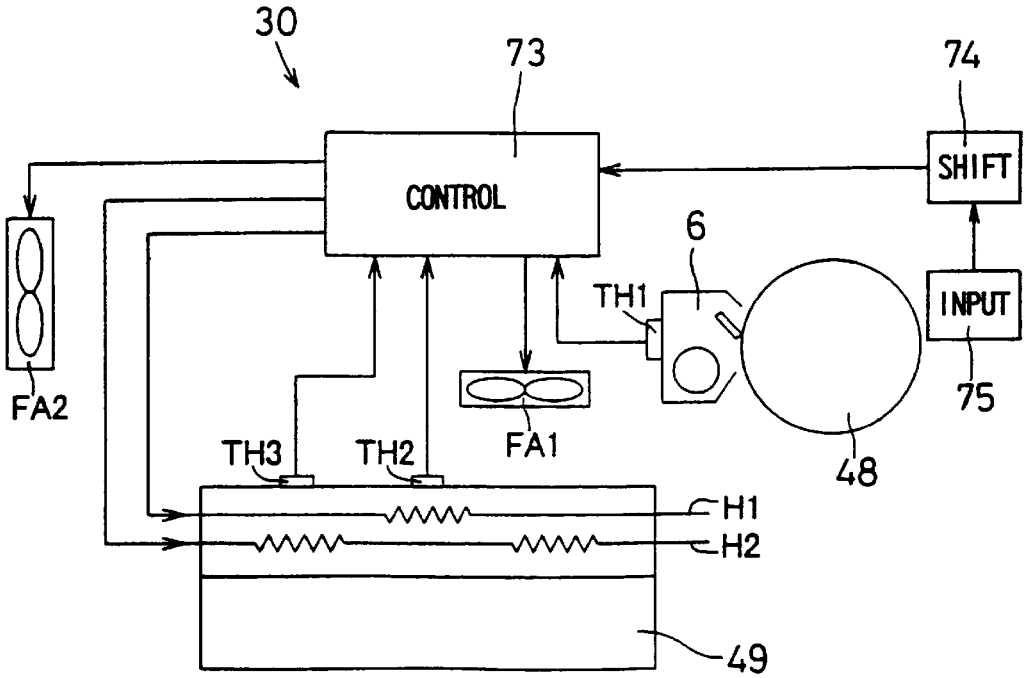
FIG. 4 is a view showing an electrical configuration of the copier 30, which is a third embodiment of the invention.

FIG. 4 is a view showing an electrical configuration of the image forming apparatus of a third embodiment of the invention. The third embodiment shows a modification of the configuration of the fixing unit 49 of the first embodiment. That is to say, a heater H2 is provided in addition to the heater H1 of the fixing unit 49 of FIG. 3, and a temperature sensor TH3 is provided in addition to the temperature sensor TH2. A resistive element of the heater H1 is placed in the center portion of the heat roller 76, and resistive elements of the heater H2 are placed on both ends of the heat roller 76, respectively. Moreover, the temperature sensor TH2 is placed so as to be opposed to the center portion of the heat roller 76, and the temperature sensor TH3 is placed so as to be opposed to one end of the heat roller 76.

The controlling section 73 controls the heaters H1 and H2, the first ventilation system FA1 and the second ventilation system FA2 in accordance with not only the temperatures detected by the temperature sensors TH1 and TH2 but also the temperature detected by the temperature sensor TH3. In this manner, the controlling section 73 responds to the temperature detected by the temperature sensor TH2 and also controls the heater H2, whereby it is possible to control the temperature more precisely.

Further, right before a recording medium passes, the controlling section 73 applies a preset voltage, e.g., a highest possible voltage, to the heaters H1 and H2 for a preset period of time. As a result, the heat deprived by the recording medium can be compensated for, and it can be avoided that toner is fixed insufficiently.

Further, various sizes of paper for PPC such as A3, A4, B4, B5 are supplied from the recording medium supplying units 51, 52, 53, and an arbitrary size of recording medium is supplied from the recording medium paper-feeding table 54. At this moment, any size of recording medium is conveyed so that its center line passes the center line of the conveying path 33. As a result, any size of recording medium passes the center portion of the fixing unit 49. In this case, by setting the amount of electricity passed through the heater H1 more than the amount of electricity passed through the heater H2, the amount of heat radiation from the heater Hi having the resistive element in the center portion of the fixing unit 49 can be made to be more than the amount of heat radiation from the heater H2 having the resistive elements on both the ends of the fixing unit. For instance, at the certain applicable maximum voltage, the period of time of applying power to the heater H1 is set to ten seconds, and the period of time of applying power to the heater H2 is set to five seconds. As a result, it is possible to supply more heat to the center portion of the fixing unit 49 where all the sizes of recording mediums pass.

Further, it is also possible to pull over the above-said all sizes of recording mediums to one end of the fixing unit 49 when passing. In this case, by setting the amount of power applied to the heater H2 more than the amount of power applied to the heater H1, the amount of heat radiation from the heater H2 having the resistive elements at the ends of the fixing unit 49 can be made to be more than the amount of the heat radiation from the heater H1 having the resistive element in the center portion. For example, at the certain applicable maximum voltage, the period of time of applying power to the heater H2 is set to ten seconds, and the period of time of applying power to the heater H1 is set to five seconds. As a result, it is possible to supply more heat to one end of the fixing unit 49 where all the sizes of sheets of paper pass.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

a housing;

a carrier for carrying a toner image to be transferred to a recording medium;

a fixing unit having a heat source, for fixing the transferred toner image on the recording medium;

a cleaner for removing toner residue on the carrier after transfer;

a ventilator for ventilating the inside and outside of the housing;

a cleaning temperature sensor for detecting a temperature of the cleaner; and a controller for controlling ventilation amount by the ventilator in accordance with an output from the cleaning temperature sensor so as to prevent the temperature of the cleaner from rising to approximately a melting point of said toner.

2. An image forming apparatus comprising:

a housing;

a carrier for carrying a toner image to be transferred to a recording medium;

a fixing unit having a heat source, for fixing the transferred toner image on the recording medium;

a cleaner for removing toner residue on the carrier after transfer;

a ventilator for ventilating the inside and outside of the housing;

a fixing temperature sensor for detecting a temperature of the fixing unit;

a cleaning temperature sensor for detecting a temperature of the cleaner; and a controller for controlling an amount of heat radiation from the heat source and amount of ventilation by the ventilator in accordance with outputs from the fixing temperature sensor and the cleaning temperature sensor.

3. The image forming apparatus of claim 2, wherein the controller has a plurality of control modes for keeping the fixing unit in different temperature conditions, the image forming apparatus further comprising:

an inputter for inputting a direction to power the apparatus on or start forming an image, and a shifter for carrying out a shift among the plurality of control modes of the controller on the basis of a signal from the inputter.

4. The image forming apparatus of claim 2, wherein the controller has a plurality of control modes for keeping the fixing unit in different temperature conditions, the image forming apparatus further comprising:

an inputter for inputting a designation of material of the recording medium, and a shifter for carrying out a shift among the plurality of control modes of the controller on the basis of a signal from the inputter.

5. An image forming apparatus comprising:

a housing;

a carrier for carrying a toner image to be transferred to a recording medium;

a fixing unit having a heat source, for fixing the transferred toner image on the recording medium;

a cleaner for removing toner residue on the carrier after transfer;

a ventilator composed of an entirety ventilating section for ventilating the entirety of the inside of the housing and a part ventilating section for ventilating a partial region of the inside of the housing, the partial region including the fixing unit and the cleaner;

a fixing temperature sensor for detecting a temperature of the fixing unit;

a cleaning temperature sensor for detecting a temperature of the cleaner; and a controller for individual control of ventilation amount of each of the entirety ventilating section and the part ventilating section in accordance with outputs from the fixing temperature sensor and the cleaning temperature sensor, wherein said controller prevents the temperature of said cleaner from rising to approximately a melting point of the toner.

6. The image forming apparatus of claim 5, wherein said entirety ventilating section and said part ventilating section are separated from each other by a partition wall.

7. An image forming apparatus comprising:

a housing;

a carrier for carrying a toner image to be transferred to a recording medium;

a fixing unit having a heat sources for fixing the transferred toner image on the recording medium;

a cleaner for removing toner residue on the carrier after transfer;

a ventilator composed of a first part ventilating section for ventilating a first region in the housing which includes the fixing unit and the cleaner, and a second part ventilating section for ventilating a second region in the housing which excludes the first region;

a fixing temperature sensor for detecting a temperature of the fixing unit;

a cleaning temperature sensor for detecting a temperature of the cleaner; and a controller for individual control of ventilation amount of each of the first and second ventilating sections in accordance with outputs from the fixing temperature sensor and the cleaning temperature sensor, wherein said controller prevents the temperature of said cleaner from rising to approximately a melting point of the toner.

8. The image forming apparatus of claim 7, wherein said first part ventilating section and said second part ventilating section are separated from each other by a partition wall.

9. An image forming apparatus comprising:

a housing;

a carrier for carrying a toner image to be transferred to a recording medium;

a fixing unit having a heat source composed of a plurality of heaters for fixing the transferred toner image on the recording medium;

a cleaner for removing toner residue on the carrier after transfer;

a ventilator for ventilating the inside and outside of the housing;

a fixing temperature sensor for detecting a temperature of the fixing unit;

a cleaning temperature sensor for detecting a temperature of the cleaner; and a controller for individual control of amount of heat radiation of each of the heaters in accordance with outputs from the fixing temperature sensor and the cleaning temperature sensor.

10. The image forming apparatus of claim 9, wherein the fixing unit further includes a roller incorporating the heaters and a pressuring member which pressures the roller, and the heaters include at least a first heater for heating a center portion of the roller and a second heater for heating an end portion of the roller, wherein the controller applies a preset amount of power to at least one of the first heater and the second heater when the recording medium to which toner is transferred passes the fixing unit.

11. The image forming apparatus of claim 9, wherein the fixing unit further includes a roller incorporating the heaters and a pressuring member for pressuring the roller, and the heaters include at least a first heater for heating a center portion of the roller and a second heater for heating an end portion of the roller, the controller applies preset amounts of power to the first heater and the second heater, respectively, right before a recording medium to which toner is transferred passes the fixing unit.

* * * * *